United States Patent [19]

Nishi

[11] Patent Number: 4,811,672

[45] Date of Patent: Mar. 14, 1989

[54] EDGE TRIMMER GUIDE FOR SEWING MACHINE

[75] Inventor: Naoichi Nishi, Sanjo, Japan

[73] Assignee: Nishi Seisakusho Co., Ltd., Niigata, Japan

[21] Appl. No.: 934,745

[22] Filed: Nov. 25, 1986

[51] Int. Cl.[4] ..... D05B 35/10; D05B 37/06

[52] U.S. Cl. ..... 112/128; 112/136

[58] Field of Search ..... 112/128, 127, 136, 148, 112/150, 153

[56] References Cited

U.S. PATENT DOCUMENTS

| | | | |
|---|---|---|---|
| 2,493,735 | 1/1950 | Alifano et al. . | |
| 2,510,929 | 6/1950 | Ketcham . | |
| 3,149,590 | 9/1964 | Fowler, Sr. . | |
| 4,389,952 | 6/1983 | Dreier et al. | 112/128 |
| 4,572,089 | 2/1986 | Nishi | 112/128 |
| 4,625,663 | 12/1986 | Mori | 112/128 |

*Primary Examiner*—Andrew M. Falk

*Attorney, Agent, or Firm*—Brumbaugh, Graves, Donohue & Raymond

[57] ABSTRACT

An edge trimmer guide for a sewing machine which is removably attached to a sewing machine has a head, a body and a foot. The cylindrical head is provided with an outer wall and an inner wall, both of which are formed integral with a vertical wall and are arranged concentrically to form a clearance therebetween into which a front edge of a side cover of the edge trimmer is fittable. The outer and inner walls extend horizontally in parallel to form a first and a second horizontal wall of the body respectively in such a way that a clearance is arranged therebetween into which a horizontal edge of the side cover of the trimmer is fittable. Another clearance is arranged between a slanted wall extended from the vertical wall and a depending wall of the first horizontal wall. A vertical edge of the side cover of the trimmer may be fitted into the second clearance while a guide foot is projected horizontally from the depending wall in parallel with the slanted wall toward the vertical wall of the head of the guide.

2 Claims, 4 Drawing Sheets

EDGE TRIMMER GUIDE FOR SEWING MACHINE

BACKGROUND AND BRIEF SUMMARY OF THE INVENTION

This invention relates to an edge trimmer guide for a sewing machine. More specifically the invention contemplates providing a guide means for an edge trimmer which is removably connected to a needle bar of a sewing machine as a unit.

A conventional edge trimmer for a sewing machine is described in U.S. Pat. No. 4,572,089, invented by the present inventor. The substance of that patent will be discussed below.

There is an upper lever pivotably supported by an L-shaped arm of a stand positioned on a base or by a bent arm of a stand integral with a holder. One edge of the upper lever is movably fastened to a needle bar of a sewing machine by a needle clamping screw for fastening a needle to the needle bar through a needle clamp body concurrently while the other end thereof is pivotably connected to one of the projected arms of a lower lever through a connecting link. When the upper lever thus constructed oscillates in unison with an up and down motion of the needle bar of the sewing machine, a cutter which is fastened dependingly to the edge of the other projected cylindrical arm of the lower lever shifts up and down with the result that the cutter thereof touches slidingly with a shearing edge defined along the front edge of the L-shaped arm portion of the base or a shearing plate fastened to the holder, whereby an edge of cloth material fed by the feeding device of the sewing machine may be trimmed.

While the edge of the cloth material is fed by the feeding device of the sewing machine toward a desired position a cloth guide plate with an upright wall along the edge thereof arranged on the L-shaped arm portion of the base located underneath the projected cylindrical arm of the lower lever equipped with the cutter serves to guide the trimmed material to be fed forward along the upright wall in a desired direction.

As the cloth guide plate is intended for guiding the trimmed material and is not designed for guiding the cloth material up to a position at which the cloth material is cut by the cutter and the shearing edge. This position may hereinafter be referred to as the cutting position.

Therefore, an operator should always handle the cloth material to be trimmed with care in order to bring it smoothly up to the cutting position from the start of the feeding operation of the cloth material.

It is thus an object of this invention to provide an edge trimmer guide which aids in feeding cloth material up to a cutting position automatically from the start of the feeding operation.

A conventional edge trimmer for a sewing machine is unmovably set on a sewing machine bed by way of a setting means such as screw means and so forth before starting feeding operation in such a way that the edge trimmer is placed at a desired position relative to a presser foot fitted to a presser foot bar of a sewing machine.

To set the edge trimmer on a sewing machine bed at a desired position relative to the presser foot already fitted to the presser foot bar by adjusting the setting means requires a great deal of skill on the part of the operator.

It is thus another object of this invention to provide a presser foot which is integral with an edge trimmer base to eliminate an extra adjustment of the setting means and is also designed to obtain a fixed position thereof relative to the cutter for smooth operation in cutting of the cloth material, which enables an operator to eliminate an extra adjustment of the setting means.

Other and further objects of this invention will become clear upon an understanding of the illustrative embodiments about to be described or will be indicated in the appended claims and various advantages not referred to herein will become apparent to one skilled in the art upon employment of the invention in practice.

DETAILED DESCRIPTION OF THE INVENTION

Figure 1:
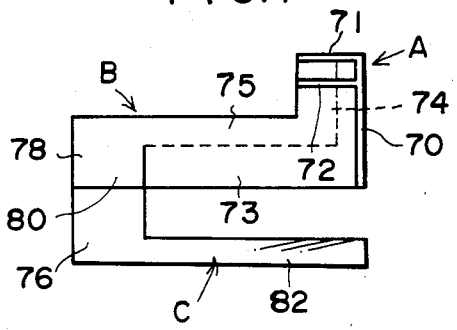
FIG. 1 is a plan view of a guide means of a trimmer for a sewing machine embodying the invention.

Referring first to FIGS. 4–9 inclusive, showing an embodiment of an edge trimmer for a sewing machine, an edge trimmer to which a guide means of this invention may be fitted will be explained in detail.

A lower lever 2 which has as its fulcrum a pin or a screw 6 fitted through a vertical stand 4 having a base 5 is formed in the shape of letter U having at one end a projected arm 8 to the end of which is pivotably connected an end of the upper lever 12 by the medium of connecting link 10 which is pivoted at 18 to the upper lever 12 and at 16 to the lower lever 2. The U-shaped lower lever 2 is also provided at its other end with a projected cylindrical arm 20 to the end of which a depending cutter 22 having a cutter blade 24 at the end thereof is fastened by means of a screw 26.

The upper lever 12 which is pivotably connected to an edge of the L-shaped arm 28 of the vertical stand 4 by a screw 30 is provided with a longitudinal U-shaped slot 32 in one end through which a needle bar 36 fitted with a needle 34 at its edge is fastened by a needle clamp screw 38. A lower base plate 40 fixed to the base 5 of the vertical stand 4 extends horizontally from the stand 4 at a right angle therewith towards the projected cylindrical lower arm 20 underneath thereof and in parallel therewith. Along a front edge of the lower base plate 40 at the back of the cutter blade 24 of the depending cutter 22 is constituted a shearing edge 42. An L-shaped presser foot holder base 44 fixed to the base 5 of the vertical stand 4 extends horizontally from the stand 4 at a right angle therewith and in parallel with the lower base plate 40.

An upright portion of the holder base 44 constitutes a presser foot holder 46 to which a presser foot 50 is pivotably connected.

The presser foot 50 is provided with a needle hole 52 surrounded by an L-shaped wall 51.

A guide plate 54 fixed to the base 5 of the vertical stand 4 also extends from the vertical stand 4 horizontally at a right angle therewith in parallel with the lower base plate 40 and the presser foot holder base 44 therebetween and one end of the guide plate 54 constitutes an upright guide wall 56 which extends in parallel with the presser foot 50. The guide plate serves to guide the edge of the cloth material already trimmed by the cutter 24 and the shearing edge 42 toward a desired direction. The lower base plate 40, the presser foot holder base 44 and the cloth guide plate 54 are arranged not only in parallel, as explained heretofore, but also flush with each other. A presser foot bar 62 may be attached to a presser foot holder 46 by means of a screw 60.

An edge trimmer cover means comprises a back cover 59 which is an upright wall integrally formed with the vertical stand 4 and a side cover 58 arranged to protect the projected cylindrical arm 20 of the lower lever 2 from damage by leaving a clearance therebetween.

The front edge of the side cover 58 is indicated by a numeral **58*a* while a horizontal edge arranged in parallel with the projected cylindrical arm 20 is indicated by 58*b*. Numeral 58*c* is a vertical edge arranged at right angle with the horizontal edge 58*b***.

Now, referring to FIGS. 1–3 inclusive, an embodiment of guide means of this invention will be explained.

A guide means comprises a head A, a body B and a foot C. A cylindrical head A is provided with a vertical wall 70, an outer wall 71 having a cylindrical wall **71*a* and an inner wall 72 having a cylindrical wall 72*a* of the inner wall 72. The cylindrical wall 72*a* is arranged concentrically with the cylindrical wall 71*a* of the outer wall 71, leaving a clearance 74 therebetween. The clearance will hereinafter be called the first slit 74. The cylindrical wall 71*a* of the outer wall 71 extends horizontally toward a body B to form a horizontal wall 71*b* while the cylindrical wall 72*a* of the inner wall 72 extends toward a body B to form a horizontal wall 72*b*. The two horizontal walls 71*b* and 72*b* of the body B are arranged in parallel to form a slit 75 therebetween. The slit 75 will hereinafter be called the second slit 75**.

Figure 2:
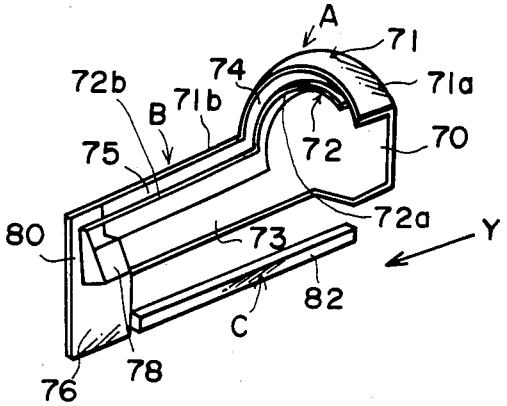
FIG. 2 is a perspective elevation view of a guide means of FIG. 1.

A slanted wall 73 of the body B which is integral with both the vertical wall 70 and the horizontal wall **72*b* is arranged slantedly forward, facing to FIG. 2 whereby An edge 78 of the wall 73 of the body B is formed in a triangular cross-section. A third slit 80 is defined between the triangle edge 78 of the wall 73 and a depending wall 76 which is integral with the horizontal wall 71*b*** of the body B.

A guide foot 82 of the foot C is projected from an edge of the depending wall 76 horizontally toward the vertical wall 70 in parallel with the slanted wall 73 leaving clearance therebetween.

The guide means of this invention may be manufactured of any light material such as plastic, especially transparent plastic, which may be most suitable for the purpose.

The guide means of this invention may be fitted to the edge trimmer for a sewing machine in the following manner.

Figure 3:
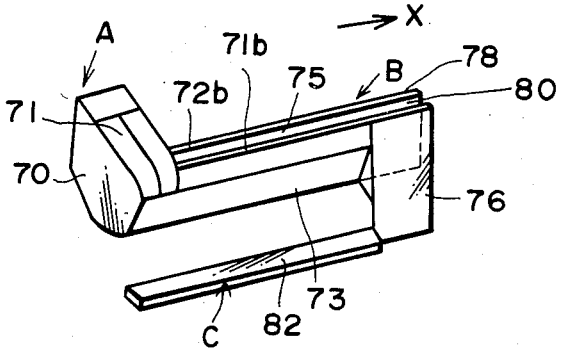
FIG. 3 is a rear elevation view of FIG. 2.

Referring to FIGS. 4, 5, 8 and 9, when the front edge **58*a* of the side cover 58 of the edge trimmer is fitted slidingly into the first slit 74 disposed between the outer wall 71 and inner wall 72 of the guide means by pushing the head of the guide means in the direction of arrows X or Y, as shown in FIGS. 2 and 3, whereby the guide means is assembled with the edge trimmer 2**.

Simultaneously the second slit 75 disposed between the horizontal wall **71*b* and 72*b* defined in the body B the horizontal edge 58*b* of the front side cover 58 while a part of the vertical edge 58*c* of the side cover 58 is slidingly fit into the third slit 80 defined between the triangle wall 78 and the depending wall 76 whereby the guide foot 82 is now positioned in front of the lower base plate 40 flush therewith and underneath the projected cylindrical arm 20**.

The edge trimmer for a sewing machine thus attached to the guide means is fitted unmovably onto the sewing machine bed by using any fastening means such as screws.

Figure 4:
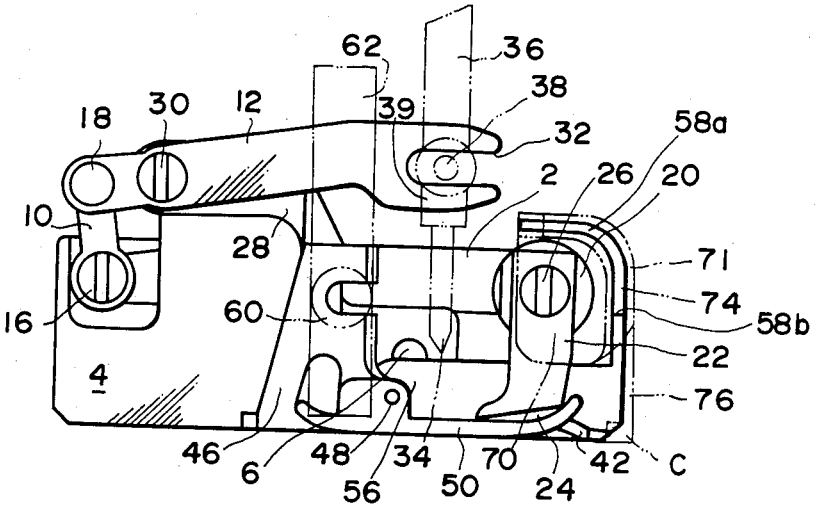
FIG. 4 is an elevation view of an edge trimmer for a sewing machine equipped with a guide means shown by phantom lines.

The longitudinal slit 32 of the upper lever 12, as shown in FIG. 4, is fastened to the needle bar 36 by means of a needle clamp screw 38 which extends through the longitudinal slit 32 to fasten the needle 34 to a needle clamp body 39 concurrently whereby in unison with the motion of the needle bar 36 driven by the sewing machine mechanism, the upper lever 12 shifts accordingly.

When the needle bar 36 is at its up position, one end of the upper lever arm 12 fastened thereto and pivotably supported by the L-shaped arm 28 by means of the screw 30' as hereinafter explained referring to FIG. 4' is also lifted upward. Simultaneously, the other end of the upper lever arm 12 moves downward. Thereby, the projected lever arm 8 of the lower lever 2 is lowered with the result that one end of the lower lever 2 which is pivotably supported by the vertical lever stand 4 is shifted downward as shown in FIG. 4 by the medium of connecting rod link 10 pivotably connecting the upper lever 12 to the projected arm 8 of the lower lever 2 while the other end of the lower lever 2 having the cylindrical arm 20 is lifted upward whereby the cutter 22 fastened dependingly to the edge thereof is also lifted upward with the cutter blade 24 touching slidingly with the shearing edge 42 of the lower base plate 40.

Figure 5:
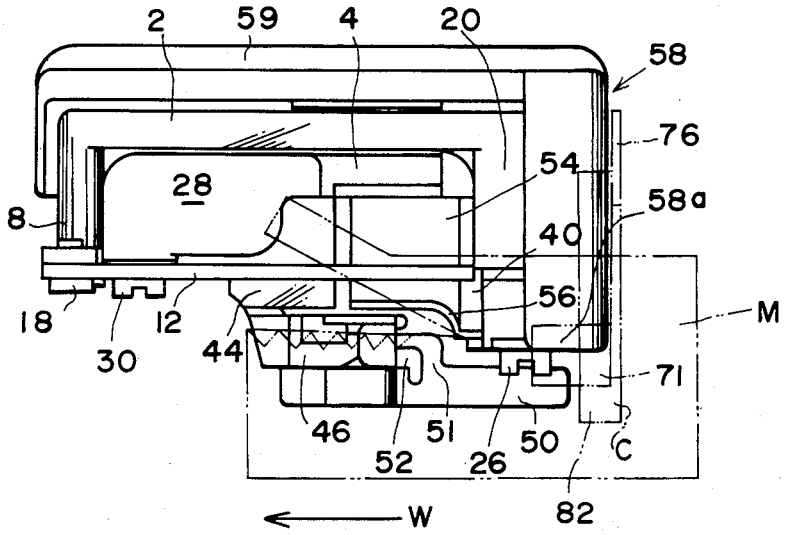
FIG. 5 is a plan view of an edge trimmer for a sewing machine equipped with a guide means shown by phantom lines.
Figure 6:
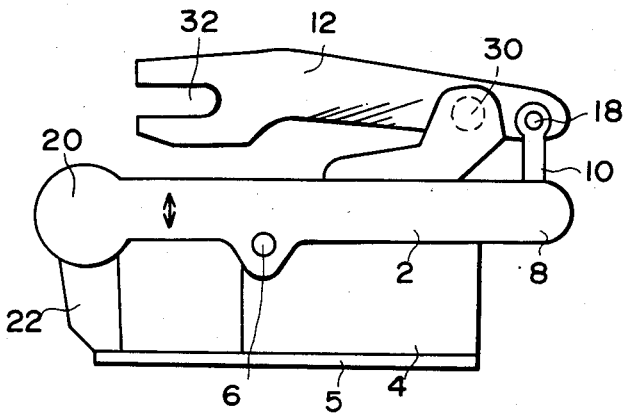
FIG. 6 is a rear elevation view of FIG. 4, a cover means being eliminated.
Figure 7:
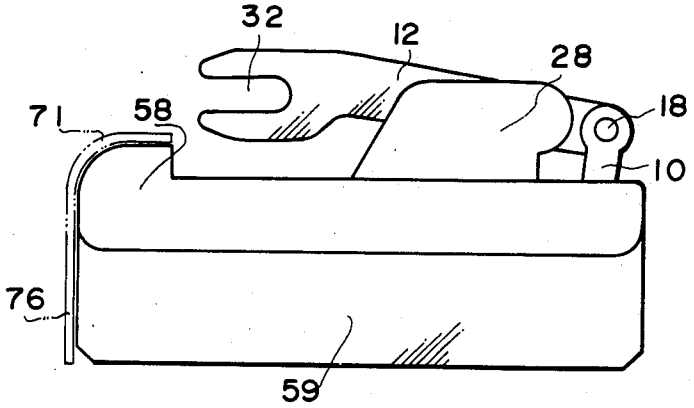
FIG. 7 is a rear elevation view of FIG. 4, equipped with a guide means shown by phantom lines.
Figure 9:
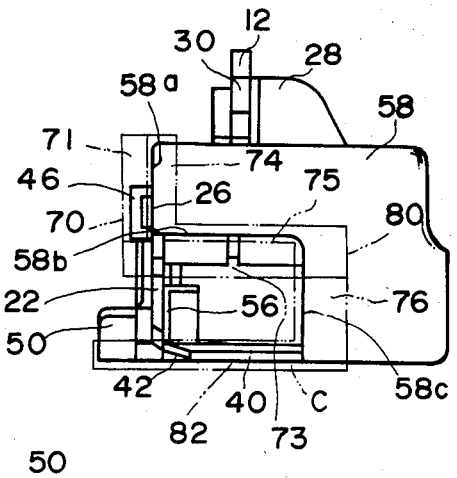
FIG. 9 is a side elevation view of FIG. 4.
Figure 8:
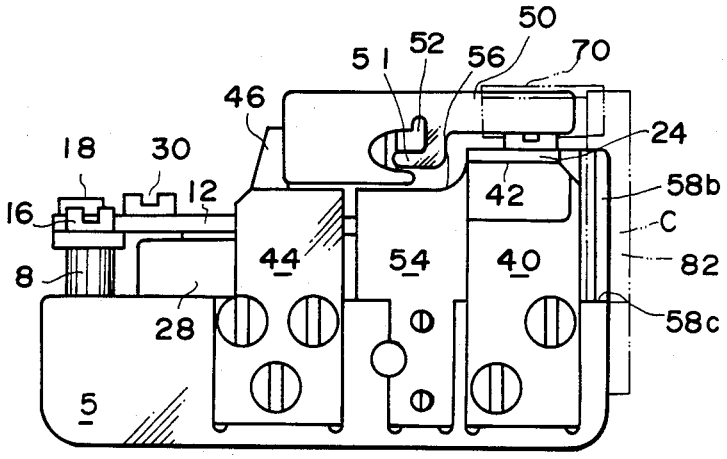
FIG. 8 is a bottom view of FIG. 5.
Figure 10:
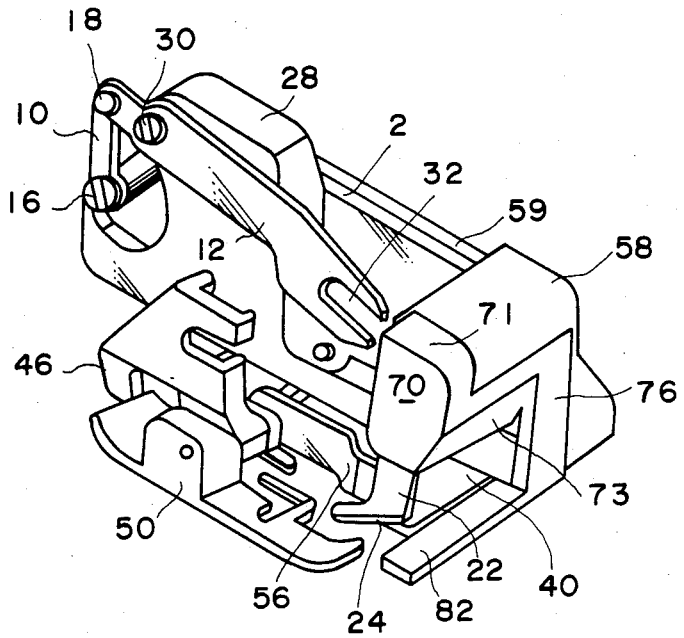
FIG. 10 is a perspective view of an edge trimmer for a sewing machine equipped with a guide means.

Whenever the upper lever 12 is shifted downward by means of reverse motion of the needle bar 36, as shown in FIG. 4, the cutter 22 is shifted downward through the related parts as heretofore plained with its cutter blade 24 touching slidingly with the shearing edge 42 and by the repeated motion of the cutter blade 24 and the shearing edge 42, the edge of the material M (FIG. 5) which is fed forward by means of a feed dog and a presser foot 50 is trimmed. Thus the material M which is fed in the direction of an arrow W by means of a feeding device as shown in FIG. 5 are trimmed successively by means of cutter blade 24 and the shearing edge 42 acting in unison with up and down movement of the needle bar 36 to which one end of the upper lever 12 is connected.

The upright guide wall 56 of the cloth guide plate 54 aids to guide the trimmed material M to be fed forwardly in a desired direction.

Lockstitch seams are usually formed along the eddge of the trimmed material immediately after trimming by utilizing two pieces of threads such as a needle thread and a bobbin thread as is known in the prior art. Also, zigzag seams are formed as shown in FIG. 5 by using a zigzag sewing machine.

Before the material M is fed up to the cutting position at which the edge thereof is trimmed by the cutter blade 24 and the shearing edge 42, the guide foot 82 which is located in front of the lower base plate 40 underneath the cylindrical arm 20 in parallel therewith when the guide means of this invention is attached to the edge trimmer as heretofore explained also serves to guide the material to the cutting position automatically, whereby a smooth feeding of the material to the cutting position may be obtained.

I claim:

1. An edge trimmer guide removably attached to an edge trimmer for a sewing machine having a needle fastened to a needle bar by a clamping screw, said edge trimmer having a stand with a base, a lower lever being pivotably supported about a mid-portion thereof by the stand and having two ends, a link being connected at one end to one of the two ends of the lower lever, an upper lever pivotably supported about a point between two ends thereof by the stand, said upper lever being connected at one end to an opposing end of the link and being connected at an opposite end to the clamping screw of the needle bar, a cylindrical arm projecting from the other end of the two ends of the lower lever, a cutter depending at one end from one end of the cylindrical arm and having a shearing edge at an opposite end for cutting cloth, means secured to the base for guiding cloth into contact with the cutter, a presser foot secured to the base, a shearing plate being secured to the base and having a shearing edge, and cover plate means, secured to the stand, for protectively extending around the cylindrical arm by leaving a clearance therebetween, said cover plate means having a back cover, a side cover with a front edge, a horizontal edge and a vertical edge, said said trimmer guide comprising:

a head having an outer cylindrical wall and an inner cylindrical wall both of which are integral with a vertical wall of the head and leave a clearance therebetween to form a first slit;

a body having two horizontal walls extended from the outer cylindrical wall and the inner cylindrical wall respectively both of which leave a clearance therebetween to form a second slit;

a depending wall and a slanted wall both of which are arranged to form a third slit therebetween; and a guide foot having a projected foot integral with the depending wall of the body, the guide foot being arranged in front of the means secured to the base for guiding cloth into contact with the cutter and underneath the cylindrical arm in parallel therewith.

2. An edge trimmer guide as claimed in claim 1 wherein the edge trimmer guide is made of a transparent plastic.

* * * * *